US007597281B2

(12) United States Patent
Letsch

(10) Patent No.: US 7,597,281 B2
(45) Date of Patent: Oct. 6, 2009

(54) ROLLER MILL HAVING A MODULAR CONSTRUCTION

(75) Inventor: Thomas Letsch, Duisburg (DE)

(73) Assignee: LOESCHE GmbH, Duesseldorf (DE)

( * ) Notice: Subject to any disclaimer, the term of this patent is extended or adjusted under 35 U.S.C. 154(b) by 144 days.

(21) Appl. No.: 11/794,100

(22) PCT Filed: Nov. 16, 2005

(86) PCT No.: PCT/EP2005/012301

§ 371 (c)(1),
(2), (4) Date: Jun. 25, 2007

(87) PCT Pub. No.: WO2006/072275

PCT Pub. Date: Jul. 13, 2006

(65) Prior Publication Data

US 2008/0041990 A1 Feb. 21, 2008

(30) Foreign Application Priority Data

Dec. 23, 2004 (DE) ..... 10 2004 062 400

(51) Int. Cl.
*B02C 15/00* (2006.01)

(52) U.S. Cl. ..... 241/121

(58) Field of Classification Search ..... 241/117–121
See application file for complete search history.

(56) References Cited

U.S. PATENT DOCUMENTS

| | | | | |
|---|---|---|---|---|
| 2,192,310 | A * | 3/1940 | Hartshorn | 241/65 |
| 2,206,145 | A * | 7/1940 | Wood | 241/53 |
| 6,021,968 | A | 2/2000 | Brundiek et al. | |

FOREIGN PATENT DOCUMENTS

| | | |
|---|---|---|
| DE | 196 03 655 A1 | 8/1997 |
| DE | 197 02 854 A1 | 7/1998 |

* cited by examiner

*Primary Examiner*—Mark Rosenbaum
(74) *Attorney, Agent, or Firm*—Jacobson Holman PLLC

(57) ABSTRACT

The invention relates to a roller mill having a modular construction.

Figure 1:
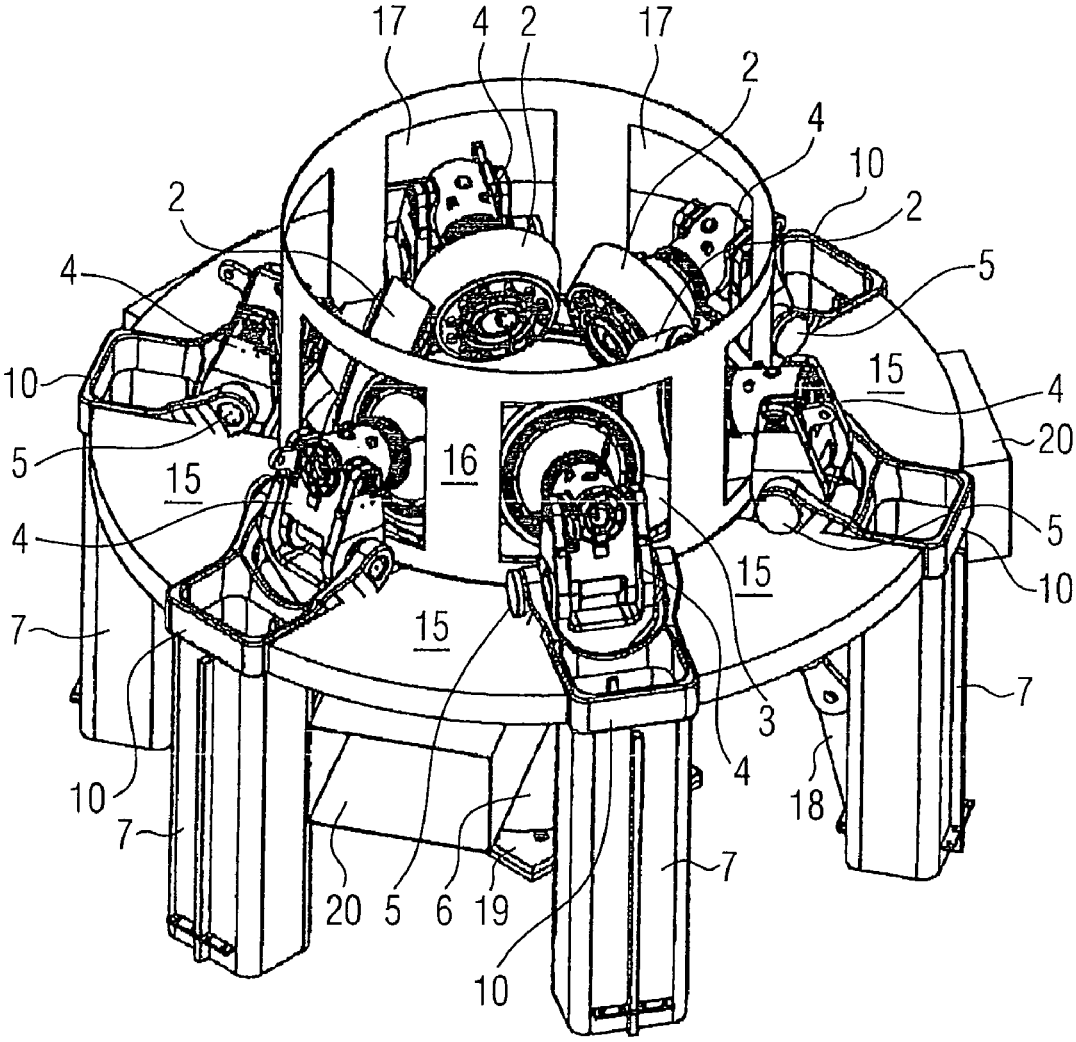

In order to permit an increased rated grinding capacity with a limited roller/rocking lever mass and a larger number of rollers, the standards are displaced outwards and the rocking lever axes, relative to the displaced standards, are positioned eccentrically and radially inwards between the grinding table and standards.

9 Claims, 3 Drawing Sheets

ROLLER MILL HAVING A MODULAR CONSTRUCTION

This is a nationalization of PCT/EP2005/012301 filed 16 Nov. 2005 and published in German.

BACKGROUND OF THE INVENTION

The invention relates to a roller mill of the modular type.

DESCRIPTION OF THE RELATED ART INCLUDING INFORMATION DISCLOSED UNDER 37 CFR 1.97 AND 1.98

Roller mills having a modular construction can e.g. be constructed according to the LOESCHE system. In such roller mills use is made of a power unit in the form of a module and which comprises a support or standard with a rocking lever bearing for a rocking lever and a grinding roller guided therein, a rocking lever seal with respect to the mill housing and a hydropneumatic suspension system (DE 196 03 655 A1).

An advantage of the modular construction is a mill structure implementable at relatively low cost and in accordance with the required grinding capacity.

On principle, roller mills with two, three, four or more grinding rollers rolling on a rotary grinding pan are known. Air-swept roller mills having a modular construction according to the Loesche system have hitherto been implemented in arrangements with two, three and four rollers. The hitherto largest Loesche roller mill for the cement industry has a rated grinding capacity of 840 t/h for cement raw material. In this mill the weight of a grinding roller with rocking lever is approximately 90 t.

In the meantime, particularly in the cement industry, there has been a need for even higher rated production rates. To implement this it is in principle possible to place larger grinding rollers, e.g. in a 4-roller mill.

However, larger grinding rollers have a much higher roller/rocking lever mass, which leads to an increase in machine vibrations during milling operation and to higher costs for the grinding rollers and the associated power transmission systems. Further disadvantages are the relatively large space requirements on installing and dismantling the grinding rollers and the heavy lifting equipment necessary for this.

In principle, it is also possible to increase the capacity of a roller mill by using a larger number of rollers, e.g. five or six grinding rollers. This means a corresponding increase in the number of standards and a smaller distance between the standards.

However, a higher rated/grinding capacity also requires the supply of higher gas flows and therefore a larger annular duct or gas ducts with a larger diameter. For a higher number of standards and adequately dimensioned gas ducts sufficient space is not available on the mill circumference. It would also be impossible to implement the necessary building area for installation and dismantling of the mill gearing and the grinding pan bearing.

BRIEF SUMMARY OF THE INVENTION

The object of the invention is to provide a roller mill having a modular construction in which, while retaining the advantages of the modular construction of a 4-roller mill, with a larger number of grinding rollers it is possible to ensure a significant increase in the rated grinding capacity while simultaneously providing adequate space for installation and maintenance work.

According to the invention this object is achieved through the features in a roller mill made up of a rotary grinding table having a center and a periphery, gearing for rotating the grinding table, and a plurality of grinding roller assemblies disposed about the periphery of the grinding table. Each of the grinding roller assemblies includes a grinding roller rolling on the rotary grinding table. An elongated standard having a top end and a bottom end is spaced a first predetermined distance outside the periphery of the grinding table. The standard has a longitudinal axis. A bearing block is secured to the top end of the standard. The bearing block is spaced a second predetermined distance from the center of the grinding table. The bearing block terminates in a rocking lever axis that is displaced radially inwards in the direction of the center of the grinding table. A rocking lever has one end pivotably mounted to the rocking lever axis and another end supporting the grinding roller.

It is a fundamental idea of the invention to make the position of the rocking lever axes with respect to the in each case associated standards such that the standard and grinding roller-rocking lever construction, as well as the grinding table or pan can be retained, while simultaneously providing adequate building space for the mill gear or the grinding pan bearing and also for the annular duct and gas ducts below the grinding pan.

For an inventive roller mill, e.g. a 6-roller mill, use is made of grinding rollers with a limited grinding roller/rocking lever mass and a grinding table, which are e.g. known from 4-roller mills. The standards advantageously also correspond to the known standards. The exception to this is the arrangement of the rocking lever axes in or on the standards.

For implementing an adequately large building area for the gearing and an adequate space for the annular duct and the gas ducts for the gas flows, according to the invention the standards are placed with a greater radial spacing from the grinding pan or the mill center, but there is no change to the position of the rocking lever axes with respect to the grinding pan or mill center.

Relative to the associated standard, the rocking lever axis is in a new position. Unlike in the known roller mills the rocking lever axis is no longer placed within the standard profile, e.g. on the longitudinal axis of the standard.

According to the invention each rocking lever axis is located outside the standard and, with respect to an annulus formed by the standards, is radially inwards in the direction of the grinding table or mill centre.

The arrangement of the rocking lever axes for the grinding rollers outside the standards simultaneously means that the rocking lever axes are no longer located within the plan views of the standards.

Thus, according to the invention the rocking lever axis is no longer on the vertical standard axis and the standards are no longer substantially cylindrical constructions with a usually rectangular cross-section and instead have an upper area with a bearing part for the rocking lever axis, which is e.g. a "broken off" or bent area directed towards the mill centre.

According to the invention the bearing part for the rocking lever axis can be integrated into the standards and manufactured therewith, which can e.g. be advantageous in the case of steel standards. The bearing part is then a part which projects in the mill centre direction and receives the rocking lever axis.

The standards can also be constructed as concrete standards. It is then advantageous to provide on the upper area of the standards a bearing block in the form of a casting and to provide the bearing block with a bearing part projecting radially inwards in the grinding table direction.

The essential advantages of the inventive roller mill are that the rated grinding capacity can be increased by the placing of several grinding rollers around a grinding table, the known and proven roller/rocking lever construction being usable and the grinding table can also essentially be retained. As only the standards are displaced radially outwards and the arrangement or positioning of the bearing for the rocking lever axis of the standards with respect to the mill centre or grinding table is unchanged, relatively limited construction and investment costs are needed for mills having different grinding capacities.

When using a bearing block it is appropriate to provide a fixing part with which the bearing block can be fixed to the standard and to place thereon the bearing part for the rocking lever axis. For example, the bearing part can be constructed in the form of two spaced flanks or side-pieces.

In the case of the inventive standard-rocking lever axis construction advantageously rigidifying measures can be provided. For example, in the upper area of the standards and the radially inwardly displaced rocking lever axes intermediate elements can be placed, which fill the spacing between the standards and the rocking lever axes and form a torsionally resistant ring or rim.

The intermediate elements can extend from the radially outer edge of the standards or also the bearing blocks up to the mill housing or up to the radially inner end of the bearing part and have an almost circular ring segmental construction.

BRIEF DESCRIPTION OF THE SEVERAL VIEWS OF THE DRAWING(S)

The invention is described in greater detail hereinafter relative to the diagrammatic drawings and wherein show:

FIG. 1 An inventive roller mill with a modular construction, but without the mill housing and classifier.

Figure 2:
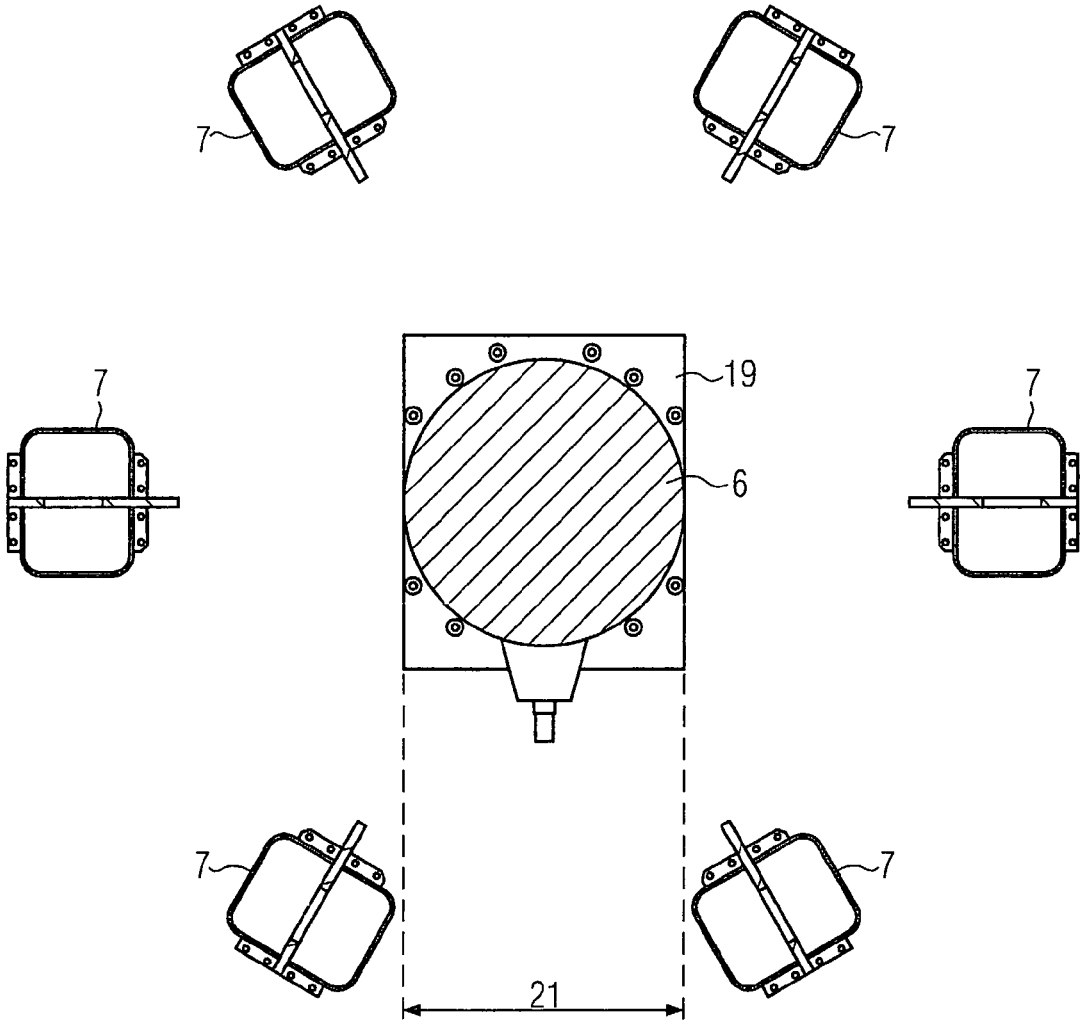

FIG. 2 A cross-section through the inventive roller mill in the vicinity of the standards and the mill gearing.

Figure 3:
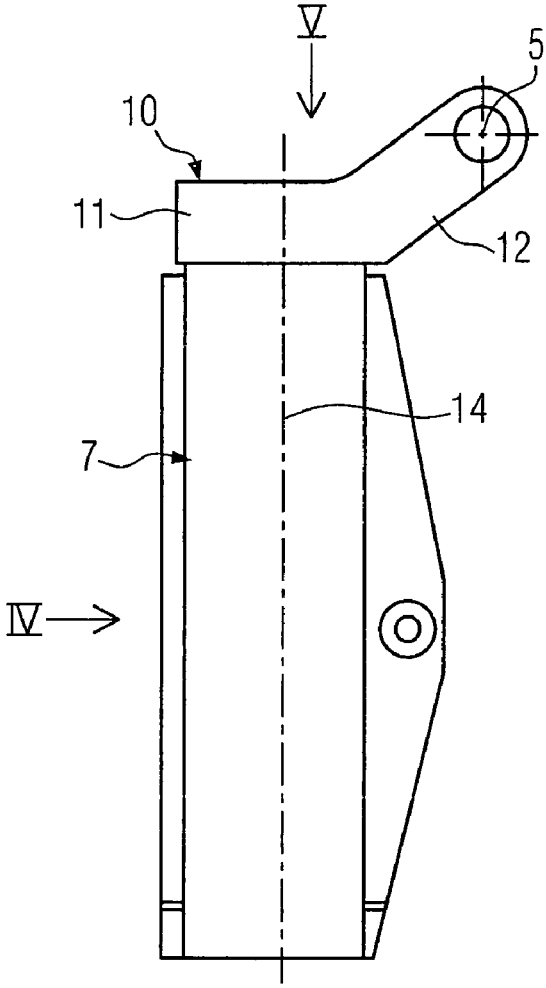

FIG. 3 A side view of a standard with rocking lever axis.

Figure 4:
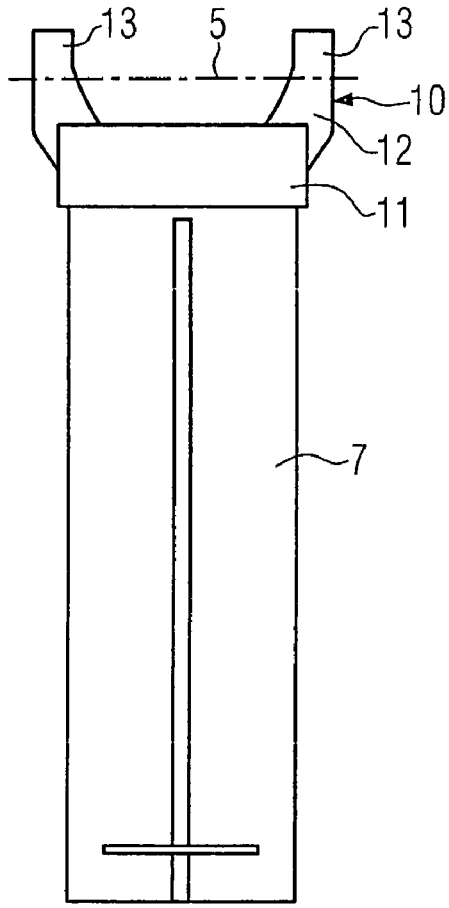

FIG. 4 A view according to arrow IV in FIG. 3.

Figure 5:
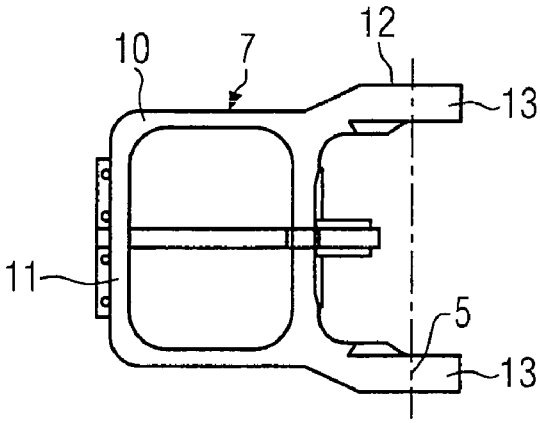

FIG. 5 A plan view according to arrow V in FIG. 3.

DETAILED DESCRIPTION OF THE INVENTION

FIG. 1 shows a perspective view of a roller mill, but only showing the components essential for the present invention. Thus, in order not to overburden representation the complete mill housing with integrated classifier is not shown.

The roller mill according to FIGS. 1 and 2 is a 6-roller mill having a modular construction. Six grinding rollers 2 are placed around a rotary grinding table 3. Each grinding roller 2 is guided in a rocking lever 4 and pivotably mounted about a rocking lever axis 5 and supported by means of said rocking lever axis on a standard 7.

For pivoting out the grinding rollers 2 and rocking lever 4 from the grinding position shown in FIG. 1 into a position (not shown) pivoted out of the mill housing 16, openings 17 are provided in said mill housing 16. The openings 17 are provided for forming a gastight mill housing 16 with corresponding covers (not shown).

Each grinding roller 2 with rocking lever 4 and horizontal rocking lever axis 5 has a hydropneumatic suspension 18, which is anchored to the standard 7 in a mill foundation (not shown).

In the mill centre, the gearing 6 and the mill drive (cf. also FIG. 2) are positioned on a gearing foundation 19. Furthermore, there are box-like gas ducts 20 between the standards 7 through which the necessary gas flows are supplied to the mill in order to pass through the blade ring (not shown) on the circumference of the grinding table 3 into the grinding area and carry the adequately ground grinding material to the classifier (not shown).

In the embodiment shown in FIG. 1 the rocking lever axes 5 of the grinding rollers 2 are mounted in a bearing block 10. The larger scale representations of a standard 7 in FIGS. 3 to 5 show the arrangement and construction of the bearing block 10. According to the invention the rocking lever axis 5 is no longer located above the standard 7 or on the longitudinal axis 14 of said standard, but instead is alongside the same and in a position displaced radially inwards towards the grinding table 3.

The bearing block 10 is fixed with a fixing part 11 to the upper area of the standards 7. To this end the fixing part 11 has a construction complementary to the upper area of the standards 7. Laterally on the fixing part 11 and directed away from the same and in upwardly sloping and projecting manner is provided a bearing part 12 in the form of two flanks 13 used for mounting the rocking lever axis 5.

As the rocking lever axis 5 is no longer located in the vicinity of the standards 7, namely within the plan view of the standards 7, but instead outside the same and, in the operating position according to FIG. 1, radially inwards between standard 7 and grinding table 3, an arrangement of more than four grinding roller-standard units around a grinding table 3 is possible at a relatively low cost. Advantageously grinding rollers 2 and rocking levers 4 with limited rollers/rocking lever masses and grinding tables 3 of a roller mill with fewer grinding rollers, particularly of a 4-roller mill, can be used.

In order to ensure the necessary spacing between the standards 7 for the requisite arrangement of adequately dimensioned gas ducts 20 and also for installation and dismantling of the gearing 6 positioned in the centre of the mill, compared with a 4-roller mill the standards 7 are displaced outwards. In order not to modify the rocking lever axis 5 with respect to the rocking lever 4 and grinding roller 2 and also in the direction of the mill centre or mill axis, the position of the rocking lever axis 5 with respect to the standards 7 was modified. In the example shown in the drawings there is an eccentric arrangement of the rocking lever axis 5 relative to the standards 7 as a result of a corresponding construction of the separate bearing block 10.

It is fundamentally also possible to integrate the radially inwardly projecting bearing part 12 with the rocking lever axis 5 to be located outside the standards 7 into said standards 7. For example, this can be achieved in the case of steel standards by a correspondingly bent or angled upper area.

In the upper area of the standards 7 and at least adjacent to the fixing parts 11 of the bearing blocks 10, intermediate elements 15 are placed for rigidification and the construction of a torsionally resistant ring.

FIG. 2 shows in highly diagrammatic form the arrangement of the mill standards 7 according to FIG. 1 in the lower area thereof. Through showing the gearing 6 in the centre of the mill with a gearing foundation 19, it is clear that the necessary building area 21 exists between two adjacent standards 7.

The standards 7 shown in FIG. 1 are represented on a larger scale in FIGS. 3 to 5 and they make clear the eccentric position of the rocking lever axis 5 outside the plan view of the standards 7. As a result of this construction or positioning of the rocking lever axis 5 between the grinding table 3 or the mill housing 16 and the given standard 7, without any significant change of the grinding table 3, grinding rollers 2 with rocking lever 4 and lower areas of the standards 7, it is achieved that more and in particular six grinding rollers 2 can be provided and an increased grinding capacity can be obtained.

The invention claimed is:

1. A roller mill having a modular construction, the roller mill comprising:

a rotary grinding table having a center and a periphery;

gearing for rotating the grinding table;

a plurality of grinding roller assemblies disposed about the periphery of the grinding table, each grinding roller assembly including a grinding roller rolling on the rotary grinding table, an elongated standard having a top end and a bottom end, the standard having a longitudinal axis which is spaced a first predetermined distance from the center outside the periphery of the grinding table, a bearing block secured to the top end of the standard, the bearing block terminating in a rocking lever axis that is displaced radially inwards in the direction of the center of the grinding table and spaced a second predetermined distance from the center of the grinding table, and a rocking lever having one end pivotably mounted to the rocking lever axis and another end supporting the grinding roller.

2. The roller mill according to claim 1, wherein the bearing block comprises:

a fixing part on the top end of the standard; and means for fixing the fixing part to the top end of the standard;

a bearing part for the rocking lever axis, the bearing part being positioned laterally on the fixing part and projected towards the center of the grinding table.

3. The roller mill according to claim 2, wherein the bearing parts are integrated with the rocking lever axis into the standards.

4. The roller mill according to claim 2 wherein the bearing part is in the form of two upwardly sloping flanks, which are spaced from one another for receiving the rocking lever.

5. The roller mill according to claim 1, wherein the number of grinding roller assemblies is six, the grinding table has a constant diameter, and the associated standards around the grinding table define a building area for the gearing.

6. The roller mill according to claim 1, further comprising a plurality of intermediate elements, each element being placed for rigidfication purposes between adjacent standards.

7. The roller mill according to claim 6, wherein the intermediate elements are located at the upper end of each standard, laterally adjacent on the bearing blocks, and forming a torsionally resistant structure.

8. The roller mill of claim 1, wherein each grinding roller assembly includes a hydropneumatic suspension anchored to the standard and the grinding roller.

9. The roller mill of claim 1, wherein the second distance is less than the first distance.

* * * * *